US008496191B2

(12) United States Patent
Grant et al.

(10) Patent No.: US 8,496,191 B2
(45) Date of Patent: Jul. 30, 2013

(54) SEAL ARRANGEMENT FOR A FUEL INJECTOR NEEDLE VALVE

(75) Inventors: Marion B. Grant, Princeville, IL (US); Vladimir Theodorof, Dunlap, IL (US); Dana R. Coldren, Secor, IL (US)

(73) Assignee: Caterpillar Inc., Peoria, IL (US)

( * ) Notice: Subject to any disclaimer, the term of this patent is extended or adjusted under 35 U.S.C. 154(b) by 754 days.

(21) Appl. No.: 12/123,065

(22) Filed: May 19, 2008

(65) Prior Publication Data

US 2009/0283612 A1 Nov. 19, 2009

(51) Int. Cl.
*F02M 59/00* (2006.01)
*F02M 61/00* (2006.01)
*F02M 63/00* (2006.01)

(52) U.S. Cl.
USPC ..... 239/533.3; 239/5; 239/533.2; 239/423

(58) Field of Classification Search
USPC ..... 239/5, 533.1, 533.2, 533.12, 423, 239/96, 533.3, 533.4; 123/299, 305, 456, 123/467
See application file for complete search history.

(56) References Cited

U.S. PATENT DOCUMENTS 4,200,237 A 4/1980 Urlaub et al.
4,202,500 A * 5/1980 Keiczek ..... 239/533.3
4,546,739 A 10/1985 Nakajima et al.
5,458,292 A 10/1995 Hapeman
5,899,389 A 5/1999 Pataki et al.
6,152,109 A 11/2000 Melchior
6,250,563 B1 6/2001 Frank et al.
6,382,533 B1 5/2002 Mueller et al.
6,725,838 B2 * 4/2004 Shafer et al. ..... 123/446
6,769,635 B2 8/2004 Stewart et al.
6,978,760 B2 * 12/2005 Stewart et al. ..... 123/299
7,134,615 B2 11/2006 Lawrence
7,143,964 B2 * 12/2006 Kuegler ..... 239/533.12
7,243,862 B2 7/2007 Dingle
7,249,722 B2 7/2007 Cibotti
7,267,109 B2 9/2007 Boehland et al.
2002/0043574 A1 4/2002 Hunkert
2002/0125339 A1 9/2002 Perr et al.
2003/0015599 A1 1/2003 Carroll, III et al.
2003/0038185 A1 2/2003 Carroll, III et al.

* cited by examiner

*Primary Examiner* — Len Tran
*Assistant Examiner* — Justin Jonaitis
(74) *Attorney, Agent, or Firm* — Leydig, Voit & Mayer

(57) ABSTRACT

A seal arrangement for a needle valve in a fuel injector (100) includes a nozzle housing (122) forming an outer cavity (216) and defining a needle valve seat (218). A plurality of nozzle openings (204) are formed in the nozzle housing (122) and arranged symmetrically around its centerline at a first radial distance (R1). An outer needle valve (104) is reciprocally mounted in the outer cavity (216) and has a seat portion (224) arranged to abut the needle valve seat (218) when the outer needle valve (104) is seated or closed. A first ledge (502) formed on the seat portion (224) of the outer needle valve (104) sealably contacts the needle valve seat (218) along a first line contact seal (220) and a second ledge (508) formed on the seat portion (224) of the outer needle valve (104) sealably contacts the needle valve seat (218) along a second line contact seal (222).

23 Claims, 4 Drawing Sheets

SEAL ARRANGEMENT FOR A FUEL INJECTOR NEEDLE VALVE

TECHNICAL FIELD

This patent disclosure relates generally to fuel injectors for internal combustion engines and, more particularly, to fuel injectors having concentric needle valves enclosed in a nozzle housing.

BACKGROUND

Fuel injectors having two concentric needle valves are known. The dual needle valves are typically used to inject one or two different fuel streams into a combustion cylinder of the engine. For direct injection engines, each power cylinder of the engine has a fuel injector capable of injecting one or more streams of fluid directly into the cylinder. For example, an engine capable of operating under different conditions may receive two different types of fuel or, alternatively, a single fuel but at different pressures and/or dispersion patterns.

U.S. Pat. No. 6,601,566 (the '566 patent), which issued on Aug. 5, 2003, and is assigned to Caterpillar Inc. of Peoria, Ill., the contents of which are incorporated herein in their entirety by reference, discloses one example of a known fuel injector having dual needles. The '566 patent discloses a fuel injector capable of injecting two distinct quantities of liquid fuel into a combustion cylinder of a dual fuel engine. The fuel injector has dual concentric check valves operating to open separate sets of orifices. These check valves are directly controlled independently from each other, and are used for pilot and main injection events.

U.S. Pat. No. 6,769,635 (the '635 patent), which issued on Aug. 3, 2004, and is assigned to Caterpillar Inc. of Peoria, Ill., the contents of which are incorporated herein in their entirety by reference, discloses another example of a known fuel injector having dual needles. The '635 patent discloses a fuel injector having a homogenous charge nozzle outlet set and a conventional nozzle outlet set controlled, respectively, by first and second needle valve members.

Known fuel injectors having dual needles do not always effectively prevent fuel leakage past the outer needle valve. It can be appreciated that the high fuel pressures present at the needle valve(s), thermal expansion effects during operation of the fuel injectors, and/or the fine tolerances required for proper fit and sealing of the various components, present obstacles to the manufacturing and operation of such injectors.

More specifically, the sealing arrangement for the outer needle valve of the injector disclosed in the '566 patent includes contact between two conical surfaces, one formed on the tip of the outer needle valve, and one formed on the inner portion of a housing. Proper fit and contact between the two conical surfaces may be very difficult to achieve in a large-scale manufacturing operation. Similarly, the sealing arrangement for the outer needle valve of the injector disclosed in the '635 patent includes either a conical surface interface, similar to the '566 patent, or a stepped bore accommodating contact between the outer needle in two directions. These and other known sealing arrangements may be prone to leakage because of the issues stated above.

SUMMARY

The disclosure describes, in one aspect, a seal arrangement for a needle valve in a fuel injector used on an internal combustion engine. The seal arrangement includes a nozzle housing forming a nozzle cavity and defining a needle valve seat surface adjacent to a distal end of the nozzle housing and along the nozzle cavity. A plurality of nozzle openings are formed in the nozzle housing and are arranged symmetrically around its centerline at a first radial distance. An outer needle valve is disposed in the nozzle cavity and has a seat portion arranged to abut the needle valve seat when the outer needle valve is seated or closed. A first ledge formed on the seat portion of the outer needle valve sealably contacts the needle valve seat along a first line-contact seal, which is circular and located at a first seal radial distance from the centerline. A second ledge formed on the seat portion of the outer needle valve sealably contacts the needle valve seal along a second line-contact seal, which is also circular and located at a second seal radial distance from the centerline.

In another aspect, the disclosure describes a fuel injector for an internal combustion engine. The fuel injector includes an injector body forming a nozzle housing that is symmetric about a centerline. An outer needle valve, which forms a centrally disposed bore, is located at least partially within the nozzle housing. An outer plurality of nozzle openings are formed in the nozzle housing along an outer needle valve seat surface and are arranged symmetrically around the centerline at a first radial distance. A distal end of the outer needle valve forms a first ledge that contacts the outer valve seat along a first line contact seal at a first seal radial distance from the centerline. Similarly, the distal end of the outer needle valve also forms a second ledge that contacts the outer valve seat along a second line contact seal at a second seal radial distance from the centerline. When the outer needle valve is seated or closed, the outer plurality of nozzle openings is fluidly blocked by the first and second line contact seals. This is accomplished by arranging the first seal radial distance to be greater than the first radial distance, and the second seal radial distance to be less than the first radial distance.

In yet another aspect, the disclosure provides a method of operating a fuel injector having dual concentric needle valves. The method includes selectively opening an inner needle valve to inject a first stream of fuel into a combustion cylinder of an engine from a nozzle chamber via an inner plurality of nozzle openings. An outer needle valve is also selectively opened, independently from the inner needle valve, to inject a second steam of fuel into the combustion cylinder from the nozzle chamber via an outer plurality of nozzle openings. The outer plurality of nozzle openings is sealed from the nozzle chamber when the outer needle valve is closed. The sealing function is accomplished by creating two line contact seals between the outer valve seat surface and the outer needle valve. The first line contact seal is formed by a first ledge, formed on the needle, and a second line contact seal is created by a second ledge that is also formed on the needle.

DETAILED DESCRIPTION

This disclosure relates to fuel injectors having dual, concentric needle valves controlling injection of a single fuel type into a power cylinder of an internal combustion engine. Each of the two concentric needle valves can be independently actuated and yield a fuel spray having desired characteristics depending on the operating mode of the engine. Both needle valves can be actuated together to yield a flow of fluid simultaneously from two sets of orifice openings that have a single flow impedance. The sealing arrangement of the outer needle valve against its valve seat is configured as a double heal seal, or, a sealing arrangement creating two unit load sealing interfaces that create an improved and effective seal. Moreover, each of the two concentric needle valves has a coefficient of thermal expansion that progressively increases radially outwardly with respect to the injector, such that undesired thermal effects are reduced or eliminated altogether during operation.

Figure 1:
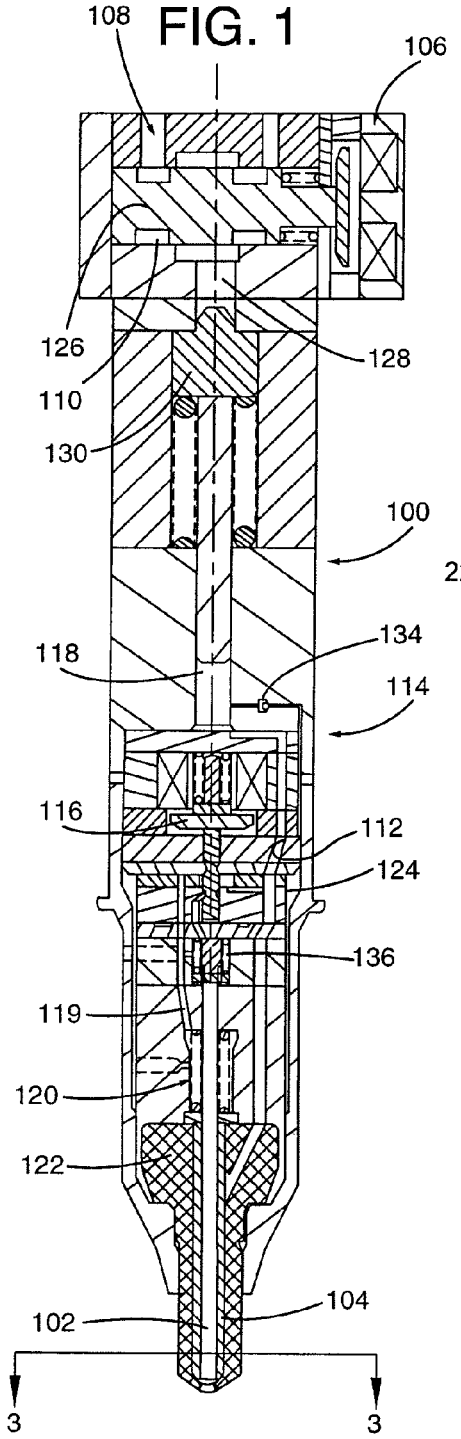
FIG. 1 is a cross section of a fuel injector having dual concentric needle valves in accordance with the disclosure.

FIG. 1 is a cross section view of a fuel injector 100 in accordance with the disclosure. The fuel injector 100 is capable of independently actuating one or both of an inner needle valve 102 and an outer needle valve 104. The fuel injector 100 is arranged for use on an internal combustion engine (not shown), and can be connected to a source of relatively high pressure fuel, such as a high pressure common rail fuel system of the engine, or any other suitable source of fuel, for example, a high pressure unit pump.

The fuel injector 100 includes an injector body 106 made up of various components attached to one another. During operation, fuel at a relatively high pressure enters the fuel injector 100 via a fuel inlet 108, which is an opening defined in the injector body 106. The fuel is supplied through a high pressure communication passage 110 to a nozzle supply passage 112, both defined in the injector body 106.

The fuel injector 100 includes a control valve 114 that is electronically controlled by, for example, a solenoid or a piezoelectric element. The control valve 114 operates to selectively displace a control valve member 116 that is movable within the injector body 106. When the control valve 114 is in the OFF position, a control volume 118 is fluidly coupled to both the high pressure communication passage 110 and to a needle control passage 119. The needle control passage 119 is fluidly open to a needle control chamber 120 that is defined within the injector body 106. A pressure force of fluid occupying the needle control chamber 120 urges the outer needle valve 104 to a closed position.

When the control valve 114 is energized and assumes an ON position, an internal passage formed in the injector body 106 fluidly couples the needle control chamber 120 to a drain 124. Pressure from the needle control chamber 120 is vented allowing a hydraulic force of fluid within the nozzle supply passage 112 to bias the outer needle valve 104 away from its seat and toward an open position.

An additional control valve 126 selectively actuates the opening and closing of the inner needle valve 102. The additional control valve 126, shown as a spool valve, selectively fluidly couples the high pressure communication passage 110 to the intensifier volume 128 formed in the injector body 106. Pressure in the intensifier volume 128 urges an intensifier piston 130 to compress fluid in the control volume 118. The control volume 118 is fluidly connected to fuel inlet 108 via a check valve 134 and is arranged to supply fuel at an intensified pressure into the nozzle supply passage 112. When the additional control valve 126 is energized, fuel at the intensified pressure in the nozzle supply passage 112 pushes against and opens the inner needle valve 102. When the additional control valve 126 is de-energized, pressure in the intensifier volume 128 is vented to the drain 124. A spring 136 biases the inner needle valve 102 to a closed position.

In this or a similar fashion, opening and closing of the inner and outer needle valves 102 and 104 can be independently achieved by energizing one or both of the control valve 114 and additional control valve 126. Selective actuation of the control valves 114 and 126 can operate to inject fuel from the fuel injector 100 via one or two different sets of nozzle openings. A view of the distal end of a nozzle housing 122 is shown in the cross sections of FIG. 2 and FIG. 3. The view in FIG. 3 has the inner and outer needle valves 102 and 104 removed for clarity.

The distal end or tip of the nozzle housing 122 surrounds both the inner and outer needle valves 102 and 104, and further provides seating surfaces for the seating of each. An inner group or inner plurality of nozzle openings 202 are formed in and extend through the nozzle housing 122 at a first radial distance, R1, from a centerline, C, of the nozzle housing 122. Similarly, an outer plurality of nozzle openings 204 are formed in the nozzle housing 122 at a second radial distance, R2, from the centerline C. When closed, the inner needle valve 102 is arranged to isolate the inner plurality of nozzle openings 202 from fluid within the injector 100. The inner needle valve 102 is closed when seated against an inner seat 206, which is an area defined along an inner surface 208 of the nozzle housing 122 adjacent and around the inner needle valve 102.

When the inner needle valve 102 is seated, an inner unit load or line contact seal 210 is formed between a section of the inner needle valve 102 and the inner seat 206. This inner seal 210 extends around the inner plurality of nozzle openings 202 and fluidly isolates them from fuel present in, at least in part, an inner cavity 212. As can be appreciated, the inner cavity 212 is a space defined radially along the nozzle housing 122 between the inner needle valve 102 and a bore 214 formed axially along and extending through the outer needle valve 104. The inner cavity 212 is typically occupied by fuel at a high pressure during operation of the injector. When the inner needle valve 102 is opened, the inner needle valve 102 is retracted from the inner seat 206 and fuel from the inner cavity 212 is permitted to flow out of the injector 100 through the inner plurality of nozzle openings 202. Because the inner plurality of nozzle openings 202 is disposed within the inner line contact seal 210, a single seal fluidly isolates the inner plurality of nozzle openings 202 from fuel in the inner cavity 212. Accordingly, the inner line contact seal 210 may be disposed at a radial distance, D1, which can be larger than the radial distance R1.

The sealing arrangement for the outer plurality of nozzle openings 204 by the outer needle valve 104 is of a different configuration because the outer plurality of nozzle openings 204 is exposed on both sides to high pressure fuel. Specifically, an outer cavity 216 is defined between the outer needle valve 104 and the inner surface 208 of the nozzle housing 122. When the outer needle valve 104 is open, fuel from both the inner cavity 212 and the outer cavity 216 can flow out of the outer plurality of nozzle openings 204. The outer needle valve 104 provides at least two seals, one disposed on each side of the outer plurality of nozzle openings 204, to fluidly isolate the outer plurality of nozzle openings 204.

The outer needle valve 104 is arranged to fluidly isolate the outer plurality of nozzle openings 204 when seated against an outer needle valve seat 218, which is an area defined along the inner surface 208 of the nozzle housing 122 adjacent to the end of the outer needle valve 104. When the outer needle valve 104 is seated, two seals are created between two sections of the outer needle valve 104 and the outer seat 218. A first line contact seal 220 is formed between the outer cavity 216 and the outer plurality of nozzle openings 204, and a second line contact seal 222 is formed between the outer plurality of nozzle openings 204 and the inner cavity 212. As can be appreciated, the first line contact seal 220 intersects the nozzle housing 122 at a first seal radial distance, D2 that is larger than the radius R2, while the second line contact seal 222 intersects the nozzle housing 122 at a second seal radial distance, D3 that is less than R2 but more than R1. The first and second line contact seals 220 and 222, together, are referred to as a double-heel seal arrangement or seat portion 224. The various elements and component features in accordance with one embodiment of this double-heel seal arrangement 224 are discussed in detail below.

Figure 4:
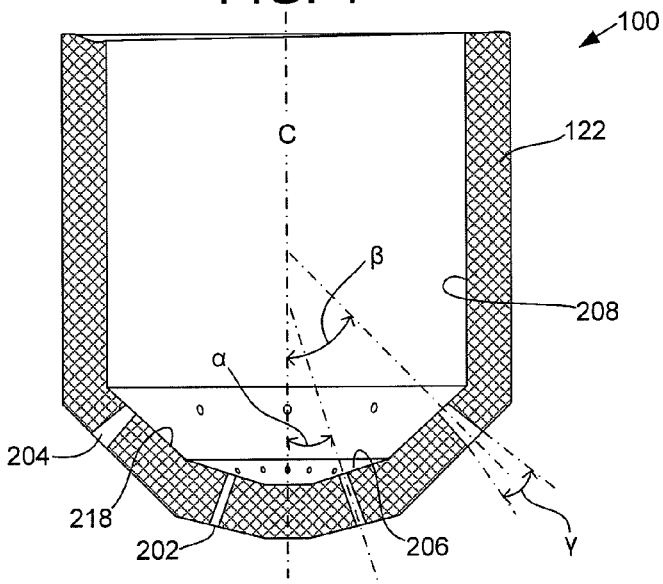

FIG. 4 is a cross section of the distal portion of the nozzle housing 122, shown with the inner and outer needle valves 102 and 104 removed for clarity. As can be appreciated, each of the inner and outer pluralities of nozzle openings 202 and 204 may be constructed the same or differently to optimize performance of the injector 100. For example, the number, opening, and orientation between the inner and outer pluralities of nozzle openings 202 and 204 may be changed to accomplish different performance enhancements to the injector 100. In the embodiment shown, each of the inner plurality of nozzle openings 202 is disposed at a first angle, $\alpha$, with respect to the centerline C, while the outer plurality of nozzle openings 204 are disposed at a different, second angle, $\beta$, with respect to the centerline C. Moreover, each opening in the outer plurality of nozzle openings 204 may have a taper or conical outlet opening forming an included angle, $\gamma$, to aid in the dispersion of fuel droplets during injection. Other differences between the inner and outer pluralities of nozzle openings 202 and 204 may be incorporated. In this embodiment, the inner plurality of nozzle openings 202 are advantageously capable of producing fuel droplets having a size, speed, and dispersion pattern that is suitable for homogenous combustion (HC) in a diesel engine. The outer plurality of nozzle openings 204 may be configured for delivery of fuel suited for conventional combustion, making the injector 100 well suited for use in a hybrid combustion-capable engine. The double-heel seal arrangement 224 offers such capabilities in a single injector.

Figure 2:
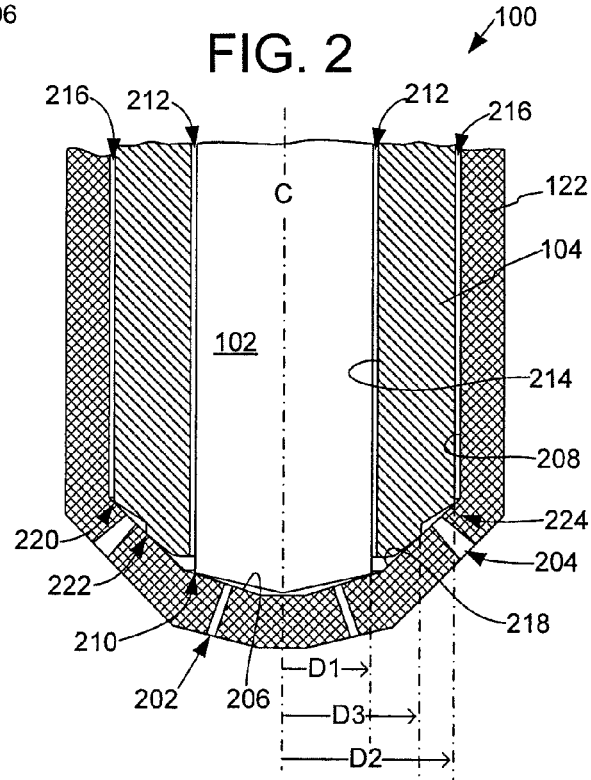
FIG. 2 is a cross section of a tip portion of a fuel injector in accordance with the disclosure.
Figure 3:
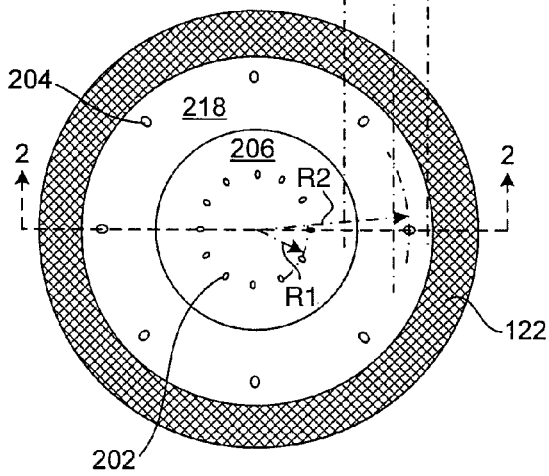
FIGS. 3 and 4 are various cross sections of a portion of a needle housing for a fuel injector in accordance with the disclosure.
Figure 5:
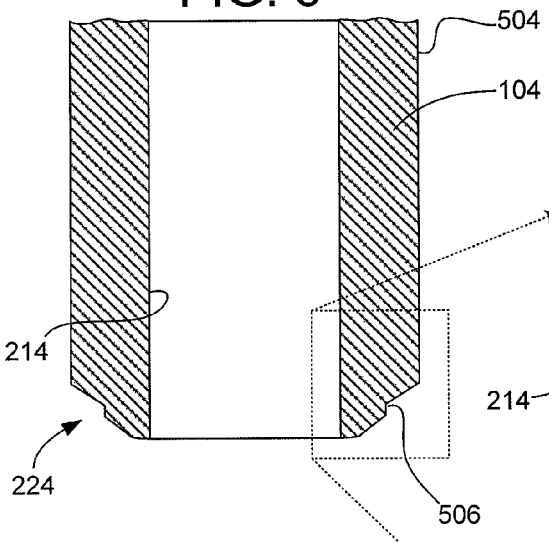
FIGS. 5 and 6 are various cross sections of a needle valve for a fuel injector in accordance with the disclosure.
Figure 6:
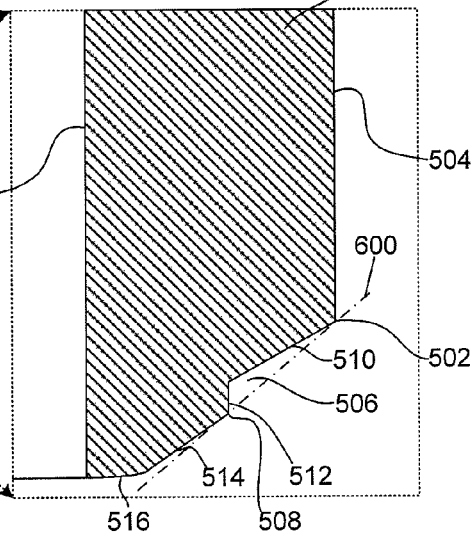

A cross section of a distal portion of the outer needle valve 104 having the double-heel seal arrangement 224 formed thereon is shown in FIG. 5, with a detail of the same view shown magnified in FIG. 6. The outer needle valve 104 has a substantially hollow cylindrical shape, with one end extending into the injector body 106 as shown in FIG. 1, and another end, the sealing end, abutting the nozzle housing 122 as shown in FIG. 2. The sealing end of the outer needle valve 104, shown in FIG. 5, forms a stepped outer bore that creates two ledges, a first ledge 502 and a second ledge 508, which extend peripherally around sections of the outer needle valve 104. The first ledge 502 defines a relatively sharp corner that extends peripherally around the outer needle valve 104, separating an outer surface 504 thereof from a recessed portion 506. The recessed portion 506 separates the first ledge 502 from the second ledge 508. The second ledge 508 also extends around the outer needle valve 104, but at a radial location that is less that that of the outer surface 504. The second ledge 508 is further located closer to the distal end of the outer needle valve 104 than the first ledge 502.

The recessed portion 506 is defined by two surfaces formed along the thickness of the outer needle valve 104. A first inclined surface 510 extends inwardly from the first ledge 502 toward the bore 214, but only partially over the entire thickness of the outer needle valve 104. At some radial distance from the bore 214, the first inclined surface transitions into a generally cylindrical surface 512 that extends axially with respect to the outer needle valve 104. The cylindrical surface 512 terminates at the second ledge 508, where another relatively sharp transition turns at an angle inwardly toward the bore 214 to define a second inclined surface 514 on the opposite side of the second ledge 508. Finally, a curved or otherwise shaped generally flat surface 516 transitions between the second inclined surface 514 and the bore 214 defining a further-most extremity of the outer needle valve 104.

The location and arrangement of the first and second ledges 502 and 508 surrounding the recessed portion 506 provides sealing surfaces for the double-heel seal arrangement 224. Specifically, when the outer needle valve 104 is seated against the nozzle housing 122 along the outer seat 218, represented by a dash-dot line 600 shown in FIG. 6, the first and second ledges 502 and 508 provide, respectively, the first and second line contact seals 220 and 222. The recessed portion 506 ensures that no other portions of the outer needle valve 104 contact the outer seat 218. This arrangement creates a unit load condition along the first and second line contact seals 220 and 222 to provide effective sealing of the outer plurality of nozzle openings 204. Even though the features herein are described in terms of ledges separating inclined or cylindrical surfaces one can appreciate that any features that effectively create two circular line contact seals are equivalents of the embodiment presented herein. For example, an alternate embodiment may have circular surfaces instead of sharp ledges providing the desired line contact seal effect. Such an embodiment is shown in FIGS. 7 and 8.

Figure 7:
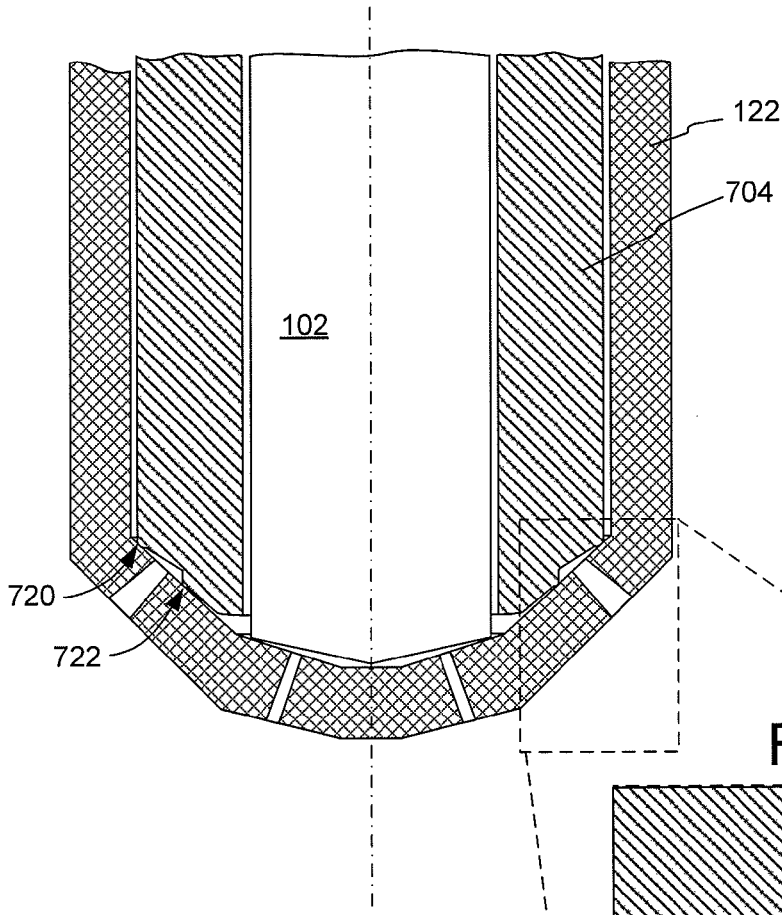
FIGS. 7 and 8 are various cross sections of an alternate embodiment for a needle valve for a fuel injector in accordance with the disclosure.
Figure 8:
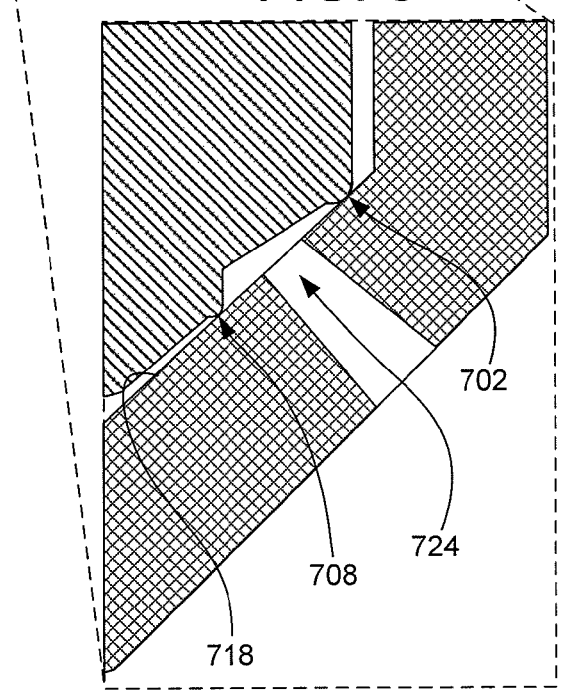

Referring now to FIGS. 7 and 8, a detail section of an alternate embodiment for a double-heel seal arrangement 724 creates first and second line contact seals 720 and 722 between an outer needle valve 704 and an outer seat 718 formed on the nozzle housing 122. The difference between this and the embodiment described above is in the shape of the first and second ledges 702 and 708, which are generally rounded. Other configurations in addition to the ones described herein, which would yield line contact seals between the nozzle housing 122 and first and second ledges on the outer needle, may advantageously yield the desired sealing function.

Performance of the various embodiments of fuel injectors disclosed herein may be further augmented by selection of materials in the manufacture of the nozzle housing, the inner needle valve, and the outer needle valve, which have progressively increasing thermal expansion coefficients and sufficient toughness to withstand high temperatures during operation without binding of any moving components. For example, the nozzle housing may be made of a tungsten carbide alloy, such as H10F, which contains about 10% Cobalt. The outer needle valve may be made of a Chromium Carbide alloy, such as CrC. The inner needle valve may be made of a ceramic or a ceramic/metal material (cermet), such as cermet materials manufactured and marketed by Kyocera®.

INDUSTRIAL APPLICABILITY

The present disclosure is applicable to fuel injectors having dual needle valves that are independently controllable to inject fuel into a combustion chamber of an internal combustion engine. The injectors described in the disclosure have improved sealing capability for blocking flow out of the injector through an outer plurality of nozzle openings during operation. The sealing arrangement described herein is a double-heel sealing arrangement that can seal a relatively large portion of an outer needle valve seat defined on the nozzle housing.

The ability to seal effectively relatively large portions of the seating areas with the inner and outer needle valves of the embodiments disclosed herein enables further optimization in the ability of the fuel injector to deliver fuel into the cylinder. These optimizations can be made to the shape and size of both pluralities of nozzle openings formed in the nozzle housing of the injector, which affects the spray pattern, droplet size, droplet velocity, and flow rate of the fuel being injected. A few examples of various nozzle opening configurations are shown in FIGS. 9-11 for illustration but, as can be appreciated, further optimizations are possible.

Figure 9:
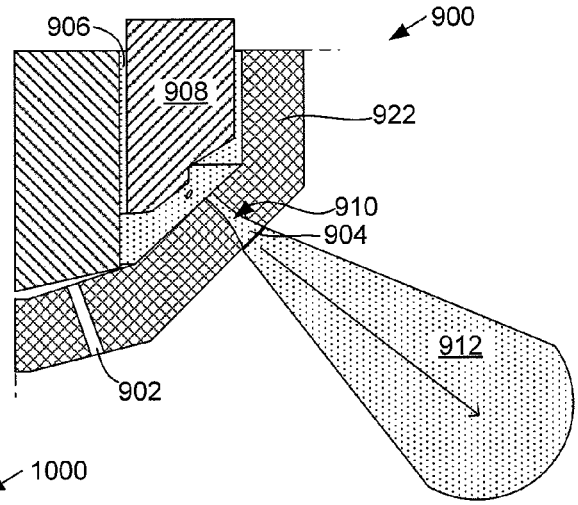
FIGS. 9 through 11 are different embodiments of fuel injectors in accordance with the disclosure.

FIG. 9 illustrates a tip portion of an injector 900. The injector 900 includes a nozzle housing 922 forming an inner plurality of nozzle openings 902 and an outer plurality of nozzle openings 904. In this embodiment, each of the outer plurality of nozzle openings 904 is shaped with an outward taper or flaring to decelerate the fuel being injected. During operation of the injector 900, fuel at an injection pressure occupies a nozzle chamber 906. When the outer needle valve 908 opens, fuel will enter each of the outer plurality of nozzle openings 904 from the nozzle chamber 906, decelerate as it passes through each respective outer injection passage 910, and produce a plume 912. The outward taper of each outer injection passage 910 may be used to decelerate the flow of fuel and yield slower-moving and relatively larger droplets of fuel in the plume 912. In this manner, an internal combustion engine operating at high speed and load conditions may combust the fuel before the spray touches any engine components, for example, the walls of the cylinder or a piston.

Figure 10:
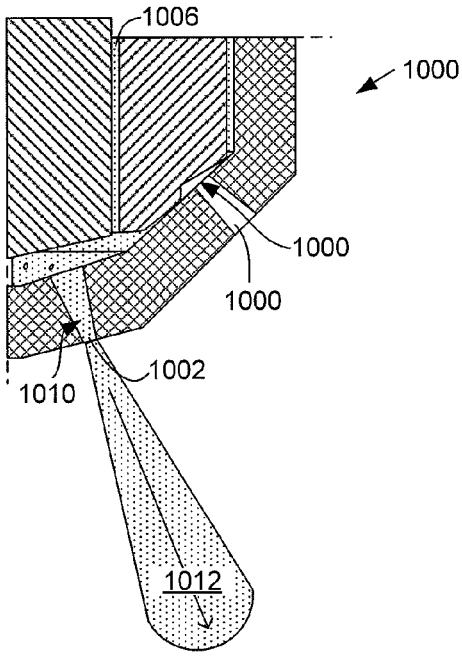

Alternatively, a tip portion of an injector 1000 having a reverse or inner-tapered plurality of nozzle openings is shown in FIG. 10. Here, each of the inner plurality of nozzle openings 1002 becomes narrower along the injection path of fuel such that a flow of fuel being injected is accelerated and the spray pattern thereof becomes more focused. During operation of the injector 1000, fuel at the injection pressure occupying a nozzle chamber 1006 accelerates as it passes through each respective inner nozzle passage 1010. The accelerated flow of fuel produces a plume 1012 that includes fuel droplets travelling faster and producing a spray pattern that is more focused than the plume 912 described above. This accelerated flow may be used, for example, on engines operating in a homogenous combustion mode. In such a case, a first stream of fuel from the inner plurality of nozzle openings may differ from a second stream from another plurality of nozzle openings in at least one of droplet size, droplet velocity and spray pattern.

Figure 11:
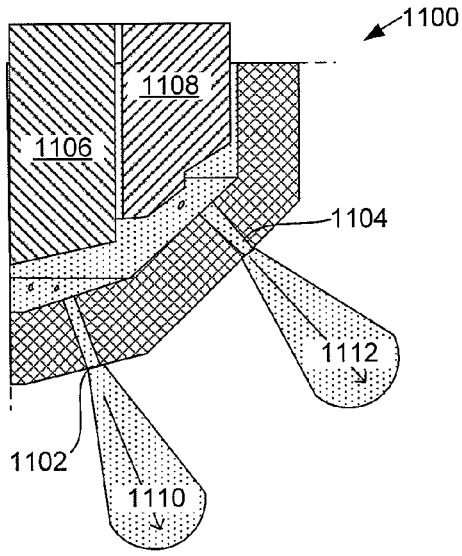

A third example of an injector 1100 is shown in FIG. 11. Here, the first plurality of nozzle openings 1102 is constructed to have the same flow impedance as the second plurality of nozzle openings 1104. Of course, the sizes and number of openings making up the first and second pluralities of nozzle openings 1102 and 1104 may differ but, when both the first and second needle valves 1106 and 1108 are open, the respective plume 1110 and 1112 of fuel spray being injected from each is the same or similar in flow rate, droplet size, and distribution. This arrangement may be used, for example, on engines having pilot fueling for low engine speeds but that require higher fuel injection flow rates at higher engine speeds and loads.

It will be appreciated that the foregoing description provides examples of the disclosed system and technique. However, it is contemplated that other implementations of the disclosure may differ in detail from the foregoing examples. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated. All methods described herein can be performed in any suitable order unless otherwise indicated herein or otherwise clearly contradicted by context.

Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein or otherwise clearly contradicted by context.

We claim:

1. A seal arrangement for a needle valve in a fuel injector for use on an internal combustion engine, the seal arrangement comprising:

a nozzle housing having a housing centerline and forming a nozzle cavity;

an outer needle valve seat disposed proximate to a distal end of the nozzle housing and along the nozzle cavity, said outer needle valve seat having a generally frusto-conical shape;

a plurality of outer nozzle openings formed in the outer needle valve seat of the nozzle housing and arranged around a first position of the housing centerline, the plurality of outer nozzle openings disposed at a first radial distance from the housing centerline;

an outer needle valve reciprocally disposed in the nozzle cavity, the outer needle valve having a needle centerline disposed along the housing centerline, the outer needle valve having a seat portion arranged to abut the outer needle valve seat when the outer needle valve is seated;

a first ledge formed on the seat portion of the outer needle valve around a first position relative to the needle centerline, the first ledge forming a sharp transition to sealably contact the needle valve seat only along a first line contact seal, the first line contact seal disposed at a first seal radial distance and around a second position relative to the housing centerline; and a second ledge formed on the seat portion of the outer needle valve around a second position relative to the needle centerline, the second ledge forming a sharp transition to sealably contact the needle valve seat only along a second line contact seal, the second line contact seal disposed at a second seal radial distance and around a third position relative to the housing centerline;

a bore formed in the outer needle valve, said bore extending axially through the outer needle valve, and an inner needle valve disposed reciprocally within the bore of the outer needle valve;

wherein the first housing centerline position of the plurality of outer needle valve openings is between the second and third housing centerline positions of, respectively, the first and second line contact seals.

2. The seal arrangement of claim 1, wherein the first radial distance is less than the first seal radial distance and greater than the second seal radial distance.

3. A seal arrangement for a needle valve in a fuel injector for use on an internal combustion engine, the seal arrangement comprising:

a nozzle housing having a housing centerline and forming a nozzle cavity;

an outer needle valve seat disposed proximate to a distal end of the nozzle housing and along the nozzle cavity, said outer needle valve seat having a generally frusto-conical shape;

a plurality of outer nozzle openings formed in the outer needle valve seat of the nozzle housing and arranged around a first position of the housing centerline, the plurality of outer nozzle openings disposed at a first radial distance from the housing centerline;

an outer needle valve reciprocally disposed in the nozzle cavity, the outer needle valve having a needle centerline aligned with the housing centerline, the outer needle valve having a seat portion arranged to abut the outer needle valve seat when the outer needle valve is seated;

a first ledge formed on the seat portion of the outer needle valve around a first position relative to the needle centerline, the first ledge sealably contacting the outer needle valve seat only along a first line contact seal, the first line contact seal disposed at a first seal radial distance and around a second position relative to the housing centerline;

a second ledge formed on the seat portion of the outer needle valve around a second position relative to the needle centerline, the second ledge sealably contacting the needle valve seat only along a second line contact seal, the second line contact seal disposed at a second seal radial distance and around a third position relative to the housing centerline;

a bore formed in the outer needle valve, said bore extending axially through the outer needle valve, and an inner needle valve disposed reciprocally within the bore of the outer needle valve;

wherein the first position along the housing centerline is between the second and third positions along the housing centerline; and a recess portion formed in the outer needle valve and disposed between and separating the first ledge and the second ledge.

4. The seal arrangement of claim 1, further comprising:

the inner needle valve forming a sharp transition ledge at a distal end thereof along a transition from a cylindrical portion to a conical tip portion thereof;

an inner needle valve seat disposed at the distal end of the nozzle housing and along the nozzle cavity, said inner needle valve seat having a generally conical shape;

a plurality of inner nozzle openings forming in the inner needle valve seat and arranged around a fourth position of the housing centerline;

said inner needle valve having a seat portion arranged to abut the inner needle valve seat along the sharp transition ledge that contacts the inner needle valve seat only along a third line contact seal, which is disposed around a fifth position of the housing centerline;

wherein the fifth position of the housing centerline is between the third and fourth positions of the housing centerline.

5. The seal arrangement of claim 4, wherein plurality of inner nozzle openings is arranged around the housing centerline and disposed at a second radial distance from the housing centerline.

6. The seal arrangement of claim 5, wherein the second radial distance is less than the second seal radial distance.

7. The seal arrangement of claim 4, wherein the inner needle valve seat has a generally conical shape.

8. A fuel injector for an internal combustion engine, comprising:

an injector body forming a nozzle housing, said nozzle housing having a housing centerline;

an outer needle valve forming a bore, the outer needle valve disposed at least partially within the nozzle housing and having an outer needle valve centerline;

an outer plurality of nozzle openings formed in the nozzle housing along an outer valve seat defined thereon, the outer plurality of nozzle openings arranged around a first position of the housing centerline and disposed at a first radial distance therefrom;

a first ledge formed adjacent to a distal end of the outer needle valve around a first position relative to the outer needle centerline, the first ledge forming a sharp transition to contact the outer valve seat only along a first line contact seal located at a first seal radial distance and around a second position relative to the housing centerline; and a second ledge formed adjacent to the distal end of the outer needle valve around a second position relative to the outer needle centerline, the second ledge forming a sharp transition to contact the outer valve seat only along a second line contact seal located at a second seal radial distance and around a third position relative to the housing centerline;

an inner needle valve reciprocally disposed at least partially within the nozzle housing and the bore;

wherein the first seal radial distance is greater than the first radial distance, and wherein the second seal radial distance is less than the first radial distance.

9. The fuel injector of claim 8, further including:

an inner plurality of nozzle openings formed in the nozzle housing along an inner valve seat, the inner plurality of nozzle openings arranged around the housing centerline and disposed at a fourth radial distance therefrom; and the inner valve seat contacting the inner needle valve along an inner line contact seal having a dimension with respect to the centerline that is larger than the fourth radial distance.

10. A fuel injector for an internal combustion engine, comprising:

an injector body forming a nozzle housing, said nozzle housing; having a housing centerline;

an outer needle valve forming a bore, the outer needle valve disposed at least partially within the nozzle housing and having an outer needle valve centerline;

an outer plurality of nozzle openings formed in the nozzle housing along an outer valve seat defined thereon, the outer plurality of nozzle openings arranged around a first position of the housing centerline and disposed at a first radial distance therefrom;

a first ledge formed adjacent to a distal end of the outer needle valve around a first position relative to the outer needle centerline, the first ledge contacting the outer valve seat only along a first line contact seal located at a first seal radial distance and around a second position relative to the housing centerline; and a second ledge formed adjacent to the distal end of the outer needle valve around a second position relative to the outer needle centerline, the second ledge contacting the outer valve seat only along a second line contact seal located at a second seal radial distance and around a third position relative to the housing centerline;

an inner needle valve reciprocally disposed at least partially within the nozzle housing and the bore;

wherein the first seal radial distance is greater than the first radial distance, wherein the second seal radial distance is less than the first radial distance, and wherein a recess is formed on the distal end of the outer needle valve and disposed between and separating the first ledge and the second ledge.

11. The fuel injector of claim 10, wherein each of the first ledge and the second ledge has a cross sectional shape along the outer needle centerline that is at least partially circular.

12. The fuel injector of claim 10, wherein the outer needle valve seat has a conical surface shape.

13. The fuel injector of claim 10, further including:

an inner cavity defined within the nozzle housing and fluidly communicating with the bore;

an outer cavity defined within the nozzle housing between an interior surface of the nozzle housing and the outer needle valve;

wherein the first line contact seal fluidly blocks the outer plurality of nozzle openings from the outer cavity; and wherein the second line contact seal fluidly blocks the outer plurality of nozzle openings from the inner cavity.

14. A method of operating a fuel injector having dual concentric needle valves, comprising:

selectively opening an inner needle valve to inject a first stream of fuel into a combustion cylinder of an engine from a nozzle chamber via an inner plurality of nozzle openings;

selectively opening an outer needle valve independently from the inner needle valve to inject a second stream of fuel into the combustion cylinder from the nozzle chamber via an outer plurality of nozzle openings;

sealing the outer plurality of nozzle openings from the nozzle chamber when the outer needle valve is closed, the sealing including:

creating only a first line contact seal between a first ledge forming a sharp transition, which is formed on the outer needle valve adjacent to a distal end thereof and around a first position relative to a centerline of the outer needle valve, and an outer valve seat surface, said outer valve seat surface having a generally frusto-conical shape, and creating only a second line contact seal between a second ledge forming a sharp transition, which is formed on the outer needle valve adjacent to the first ledge and around a second position relative to the centerline, and the outer valve seat surface.

15. The method of claim 14, wherein the first line contact seal forms a contact line disposed at a radial distance that surrounds the outer plurality of nozzle openings.

16. The method of claim 14, wherein the second line contact seal forms a contact line disposed at a radial distance that is between the inner plurality of nozzle openings and the outer plurality of nozzle openings.

17. The method of claim 14, further including providing a recess portion between the first ledge and the second ledge, wherein the first ledge and the second ledge are sharp surface transitions.

18. The method of claim 14, wherein the first stream and the second stream differ in at least one of droplet size, droplet velocity and spray pattern.

19. The seal arrangement of claim 3, wherein the recess portion is defined by an inclined surface extending inwardly from the first ledge, and by a cylindrical surface extending between the inclined surface and the second ledge, the cylindrical surface extending axially with respect to the outer needle valve.

20. The seal arrangement of claim 10, wherein the recess is defined by an inclined surface extending inwardly from the first ledge and transitioning into a generally cylindrical surface that extends axially with respect to the outer needle valve.

21. The seal arrangement of claim 1, wherein said nozzle housing and said outer needle valve are made of different materials having progressively increasing thermal expansion coefficients.

22. The seal arrangement of claim 1, wherein said nozzle housing is made of a tungsten carbide alloy and wherein the outer needle valve is made of a Chromium Carbide alloy.

23. The seal arrangement of claim 22, wherein said nozzle is made of an H10F alloy, which contains about 10% Cobalt, and wherein the outer needle valve is made of a CrC alloy.

* * * * *